United States Patent [19]

Viljanmaa

[11] 4,335,594

[45] Jun. 22, 1982

[54] APPARATUS FOR HIDE STRETCHING

[76] Inventor: Antti K. Viljanmaa, Torisevantie 4 A 8, 34800 Virrat, Finland

[21] Appl. No.: 113,706

[22] Filed: Jan. 18, 1980

[30] Foreign Application Priority Data

Jan. 18, 1979 [FI] Finland ..... 790156

[51] Int. Cl.[3] ..... C14B 1/26; D06C 3/08

[52] U.S. Cl. ..... 69/19.3; 38/102.91

[58] Field of Search ..... 69/19, 19.1, 19.3, 33, 69/34, 35, 19.2, 21; 38/102.1, 102.91

[56] References Cited

U.S. PATENT DOCUMENTS

| | | | |
|---|---|---|---|
| 1,911,556 | 5/1933 | Staebler | 69/19.3 |
| 3,391,635 | 7/1968 | Matheus | 69/19.3 |
| 4,202,190 | 5/1980 | Viljanmaa | 69/19.3 |

FOREIGN PATENT DOCUMENTS

| | | | |
|---|---|---|---|
| 648610 | 2/1979 | U.S.S.R. | 69/19 |

*Primary Examiner*—Patrick D. Lawson

*Attorney, Agent, or Firm*—Schiller & Pandiscio

[57] ABSTRACT

A hide stretching apparatus, in particular one for the tentering of hides for drying. The apparatus comprises a stretching frame (1) with a number of mutually spaced radial sliding guides (2). The stretching clamps (4) gripping the edges of the hide have been arranged to be reciprocatingly movable along the sliding guides (2). The stretching frame (1) is placed upon a special hide changing table (10) carrying under each sliding guide a clamp displacement member (12). The clamps (4) carry jaws (5 and 6) which attach to the edge of the hide (11) to be stretched. The jaws are opened and closed by means of a lever (9) turnably carried on the clamp. The clamp displacement member (12) has two gripping members (15, 18*a*) which can be made to engage the clamp (4) on both sides according to commands given, for the displacing of the clamps (4) reciprocatingly along the sliding guides (2). The clamp displacement member (12) also has a lever (9) driven by a cylinder (16), the lever (9) having a cam (19*a*) which can be brought into and out of engagement with a recess (9*a*) of the lever (9) on the clamp (4).

The hide changing table (10) is fitted with radial support strips (24) to be placed adjacent to the sliding guides (2). A vertically movable pressmeans (28) is provided with radial press members (33) which can be pressed upon the support strips (24) in order to keep the hide (11) in position between the support strips and press members while securing the stretching clamps (4) to the margin of the hide (11).

10 Claims, 4 Drawing Figures

APPARATUS FOR HIDE STRETCHING

The present invention relates to an apparatus for the stretching of hides, particularly for tentering wet hides for drying thereof, said apparatus comprising a stretching frame and stretching clamps to be attached to the margin of the hide, these clamps being arranged to be movable to and fro by means of clamp displacing members on the hide changing table along radial sliding guides fitted on the stretching frame.

This type of apparatus is disclosed in the applicant's Finnish patent publication No. 55682. The apparatus has proved to be very practical in use and, thus, the object of the present invention is to improve the reliability and security of the clamp attachement to the margin of the hide.

According to the invention, this object is achieved by providing the hide changing table with radial support strips fitted adjacent to the sliding guides and by fitting the apparatus with a vertically movable press means provided with radial press members which can be pressed upon the support strips to secure the hide in position between the support strips and press members when the attachment clamp s are secured to the margin of the hide. By virtue of this arrangement, corrugation and unevenness of the hide margin can be eliminated and the hide margin can be always held in a plane above the upper sliding guides of the stretching frame, in which plane a stretching clamps controlling sensing hair moves and in which the gap between the jaws of the stretching clamps is located.

Figure 2:
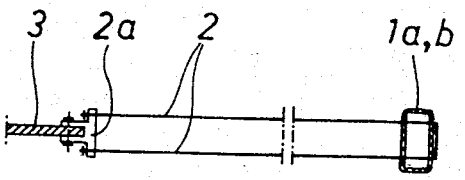
Figure 1:
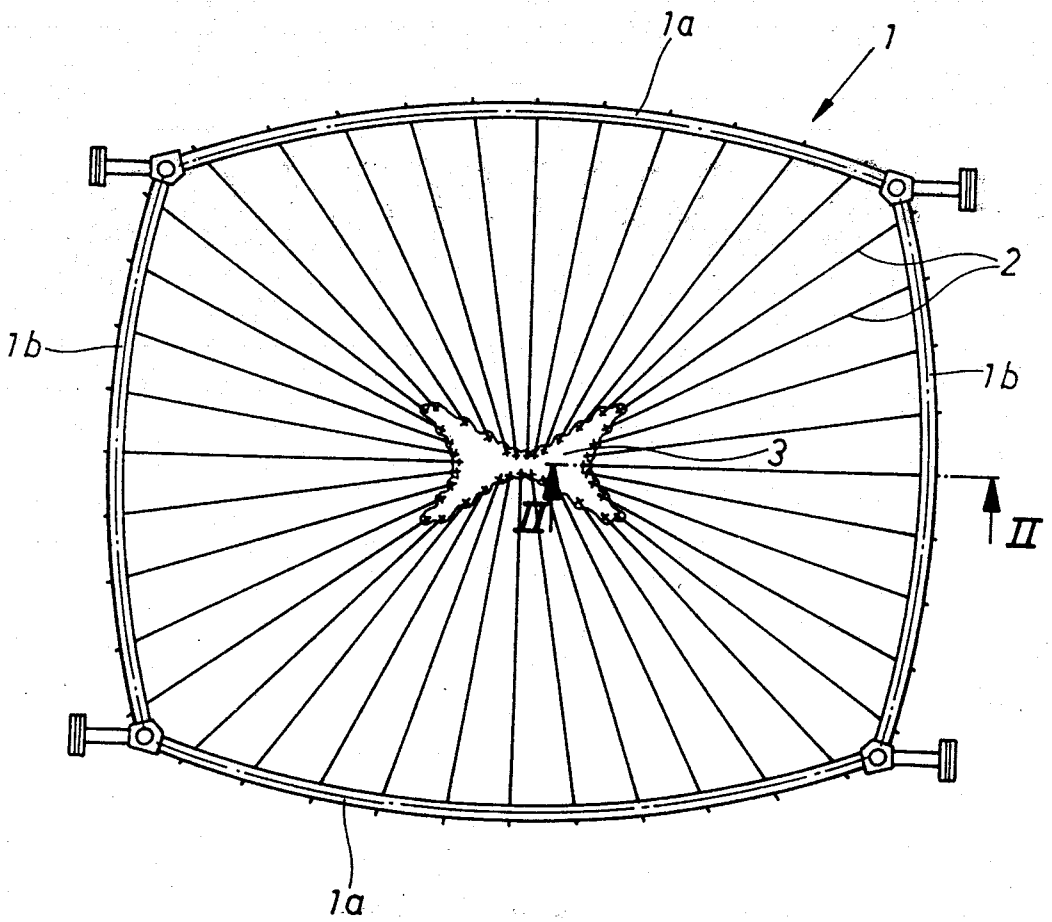
Figure 3:
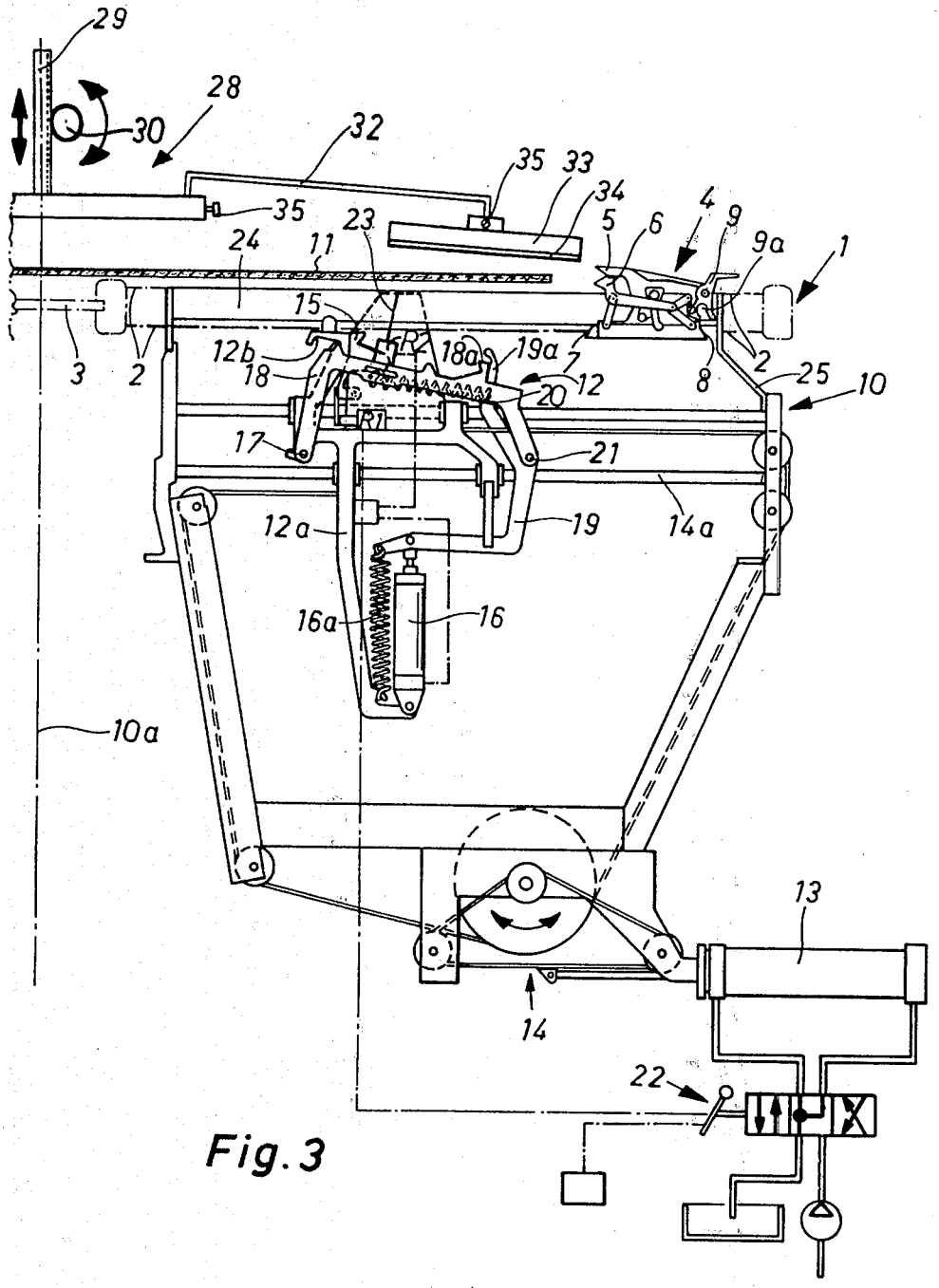
Figure 4:
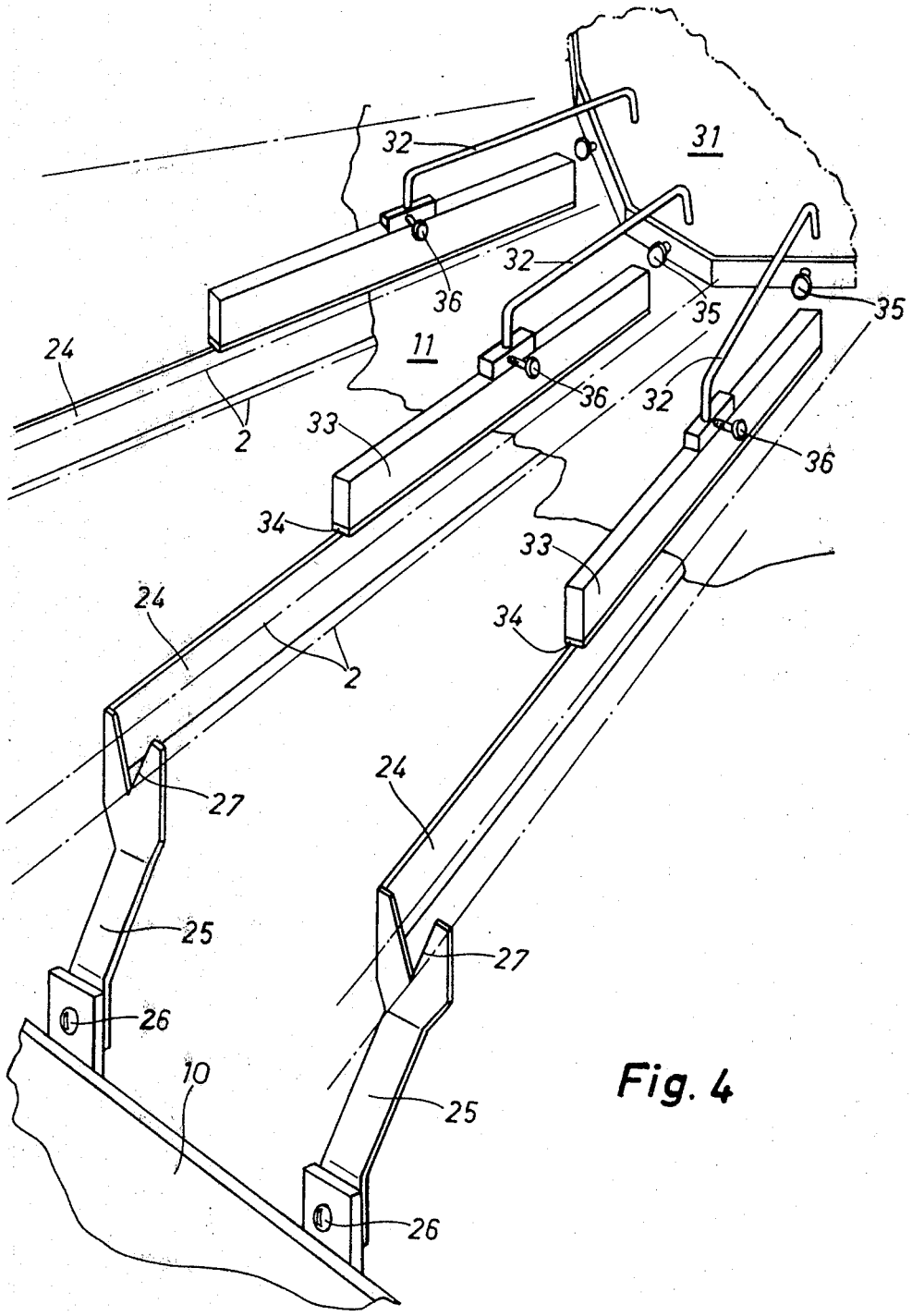

The following is a more detailed description of one embodiment of the invention with reference made to the accompanying drawings, in which:

FIG. 1 is a plan view of the stretching frame which is part of the present apparatus, FIG. 2 is a sectional view along the line II—II of FIG. 1, FIG. 3 shows the apparatus of the invention in side view and in partial vertical section, and FIG. 4 is a perspective view of a detail of the present apparatus.

The stretching frame illustrated in FIG. 1 comprises four tube members 1*a*, 1*b* of rectangular cross-section secured together at the ends thereof to form a substantially quadrangular frame. Between the frame components 1*a* and 1*b* and the centre member 3 there have been tightly stretched radially extending sliding guides made e.g. of steel wire, along which the hide stretching clamps slide as described later on in connection with FIG. 3. Sliding guides 2 are affixed to the plate-shaped centre member 3 by means of fixing pins 2*a* which are pivotable in the direction of pull. Frame components 1*a* and 1*b* are outwardly curved in order to take up tensile forces. The centre plate 3 has the shape appearing in FIG. 1 in order to make the sliding guides 2 substantially equal in length. As can be seen from FIG. 2, the sliding guides have been formed so that the arms of steel wire 2, bent into U-shape, lie one above the other in vertical plane.

Since the construction of the stretching clamp itself is not an object of this invention, reference is made here to the above-cited applicant's Finnish patent publication No. 55682.

FIG. 3 shows by means of dotted lines the stretching frame of FIG. 1 positioned on a hide changing table generally designated by reference numeral 10. On each pair of slide guides 2, fitted one on top of the other, there is a slidable stretching clamp 4 whose jaws 5, 6 can be opened and closed by means of a pivotable lever 9. In order to displace it, the stretching clamp 4 has in its opposite lower edges abutment faces 7 and 8. In order to move clamp 4 so that it clamps the margin of hide 11 resting on the stretching frame, the hide changing table 10 is fitted with clamp displacement means 12, which are moved along sliding bars 14*a* by means of hydraulic piston-cylinder means 13 through a belt or chain drive 14. With clamp displacement means 12 moving from the position depicted in FIG. 3 to the right, the engagement member 15 abuts the abutment face 7 of clamp 4, which via the action of limit switch $R_1$ stops the clamp displacement means 12 and and urges the cylinder 16 against the force of spring 16*a* to pivot the lever mechanism 18, 19 upwards with respect to frame 12*a* round the axle 17. Under the action of the spring 20 connected between levers 18 and 19, both levers 18 and 19 first rise simultaneously. When the lever 18, which is fitted with the engagement means 18*a*, has risen to sufficient level for engagement with the abutment face 8 of clamp 4, the clamp 4 will stop against the frame abutment 12*b*, but the piston of cylinder 16 will continue its movement turning the lever 19 round the axle 21 against the force of spring 20. Prior to that, the cam 19*a* of the lever 19 has entered the recess 9*a* in the lower edge of lever 9. Thus, the turning action of lever 19 effects the turning of lever 9 and opening of jaws 5, 6.

In order to bring clamp 4 into engagement with the margin of hide 11, a control 22 is used to move the piston of cylinder 13 in such a manner that it effects the movement of clamp displacement means 12 along sliding bars 14*a* towards the centre 10*a* of the hide changing table. Since the engagement member 18*a* is in engagement behind the abutment face 8, the member 12 carries therealong the clamp 4 which has jaws 5, 6 already opened. When cylinder 16 effected the turning up of the lever system 18, 19, it simultaneously lifted the sensing hair 23 to such a level that the upper end of sensing hair 23 exceeds the plane of the top surface of the upper sliding guides 2, on which plane the hide 11 is resting. For the sake of clarity, the drawing depicts the hide 11 above said plane. When it touches the edge of hide 11, the sensing hair 23 effects through the limit switch $R_2$ stop control of the clamp displacement means 12 and the downward movement of the piston of cylinder 16 back towards the condition of FIG. 3, the engagement member 18*a* disengaging from the abutment face 8 and cam 19*a* of the lever 19 turning the lever 9 to the position in which jaws 5, 6 close. When he observes that all clamps are secured to the margin of hide 11, the operator directs by means of control 22 the clamp displacement means 12 to move in the hide 11 stretching direction or to the right in FIG. 3, whereby the engagement means 15, still in engagement with abutment face 7, pushes clamp 4 therealong. For the duration of this hide stretching control, the limit switch $R_1$ is switched off. To keep the margin of hide 11 always at exact height in the area where the sensing hair 23 and jaws 5, 6 move, the invention provides radial support strips 24 on the hide changing table so that they fit adjacent to each pair of sliding guides 2 of the stretching frame 1. As depicted in FIG. 4, the outer ends of support strips 24 are secured to arms 25 whose lower ends are pivotably supported by a turning axle 26 and whose upper end forms a V-shaped converging guide fork 27. When fitting the stretching frame 1 in position on the hide changing table 10, the lower sliding guides 2 are received in V-shaped guide forks and the turning arms 25 will be positioned so that the support strips 24 will take exact positions with respect to sliding guides 2. With the lower sliding guide 2 resting on the bottom of guide fork, the top surface of the upper sliding guide 2 will be at the same level with the upper surface of support strip 24.

In addition to this, the apparatus comprises, fitted on the centre axis 10*a* of the hide changing table 10, a press means 28 which is moved in vertical direction by means of a rack bar 29 and a gear 30. The central plate 31 of the press means, fitted on the lower end of the rack bar 28, has secured thereto radially extending flexible arms 32 whose ends comprise radially extending press members 33. Arms 32 can be locked in desired direction by means of a locking means 35 and the direction of press members 33 at the ends of the arms can be locked by means of a locking means 36. Thus, the press members 33 can be accurately set in such a position that, when the press means 28 is lowered down, the press members 33 come on the top of support strips 24. Hence they press the margin of hide 11 to exactly adjusted position. Since sliding guides 2 lie adjacent to support strips 24, the position of the hide margin is also above the sliding guides accurate and exact in the plane between the clamp jaws 5, 6. The flexible arms 32 are preferably directed slightly downwards so that, with press members 33 abutting to support strips 24 and arms 32 deflecting upwards, the press members 33 simultaneously move slightly outwards in radial direction. This effects straightening of the hide and produces slight pretension prior to the stretching to be effected by means of stretching clamps 4. For more intense straightening of hide, the upper surfaces of support strips 24 consist of slippery metal surfaces and the lower surfaces of press members 33 are provided with a nonslipping gripping surface 34 of rubber.

Thus, the apparatus of the present invention provides for effective and automatic straightening and pretentering of hide prior to attaching the stretching clamps 4 to the hide margin, thus securing the attachment of clamps 4 and eliminating disturbances in automatic operation.

I claim:

1. In a hide stretching apparatus, in particular for the tentering of wet hides for drying, of the type comprising in combination:

a stretching frame having peripherally attached thereto and radially extending inwardly therefrom a plurality of guides, each of said guides having a first end affixed to said frame and a second end affixed to a center piece located centrally in said frame;

a like plurality of clamps, individual ones of said clamps being slidably attached to corresponding ones of said guides so as to be movable in an inward direction and an outward direction, respectively toward said second end and said first end of a corresponding one of said guides, each of said clamps being provided with a pair of jaws operable between an open position and a closed position, said jaws being so disposed and dimensioned as to be capable of grasping an edge of a hide when in said closed position and releasing said edge when in said open position; and a hide changing table provided with a clamp displacement member for each of said clamps, said clamp displacement member being dimensioned and disposed so as to be capable of translating an individual one of said clamps along said corresponding one of said guides;

the improvement comprising a plurality of support strips affixed to said hide changing table, said support strips being dimensioned and disposed to fit adjacent said guides when said stretching frame is aligned on said hide changing table; and a vertically movable press means provided with press members disposed in confronting relationship to said support strips, said press members being so dimensioned and disposed as to grasp a hide when said press means is in its lowermost position and release said hide when said press means is in its upermost.

2. Apparatus according to claim 1 wherein further each said guide is a pair of parallel members fitted on top of one another such that when the stretching frame is positioned on said hide changing table the upermost of said members is substantially in the same plane with the upper edge of the support strip.

3. Apparatus according to claim 1 wherein further the press members are secured to a centre plate of the press means by means of flexible arms.

4. In a hide stretching apparatus, in particular for the tentering of wet hides for drying, of the type comprising in combination:

a stretching frame having peripherally attached thereto and radially extending inwardly therefrom a plurality of guides, each of said guides having a first end affixed to said frame and a second end affixed to a center piece located centrally in said frame;

a like plurality of clamps, individual ones of said clamps being slidably attached to corresponding ones of said guides so as to be movable in an inward direction and an outward direction, respectively toward said second end and said first end of a corresponding one of said guides, each of said clamps being provided with a pair of jaws operable between an open position and a closed position, said jaws being so disposed and dimensioned as to be capable of grasping an edge of a hide when in said closed position and releasing said edge when in said open position; and a hide changing table provided with a clamp displacement member for each of said clamps, said clamp displacement member being dimensioned and disposed so as to be capable of translating an individual one of said clamps along said corresponding one of said guides;

the improvement comprising a plurality of support strips affixed to said hide changing table, said support strips being dimensioned and disposed to fit adjacent said guides when said stretching frame is aligned on said hide changing table, each one of said support strips having an outer end fixed in a V-shaped converging guide fork, said guide fork being supported to be movable in a direction transverse to said one, said guide fork being adapted to receive the sliding guide of the stretching frame, whereby the support strip may be caused to move to a given point with respect to an adjacent sliding guide of the stretching frame; and a vertically movable press means provided with press members disposed in confronting relationship to said support strips, said press members being so dimensioned and disposed as to grasp a hide when said press means is in its lowermost position and release said hide when said press means is in its upermost.

5. Apparatus according to claim 4 wherein further each of said guides includes a pair of paralles guide members fitted on top of one another and said guide fork is dimensioned and disposed such that when the stretching frame is positioned on said hide changing table the upermost of said guide members is substantially in the same plane as the upper edge of the support strip.

6. In an apparatus for hide stretching, particularly for tentering of wet hides for drying, comprising a stretching frame having stretching clamps to be secured to the margin of the hide and arranged to be movable to and fro, by means of clamp displacing means fitted on a hide changing table, along radial sliding guides on the stretching frame, the improvement wherein each clamp displacing means has a frame provided with two levers, one of said two levers being attached by means of a pivot axle to the clamp displacing means frame and the other of said levers is attached by means of another pivot axle to the free end of the first lever, wherein a piston-cylinder means is arranged between between the clamp displacing means frame and the free end of said another lever, wherein the first lever is provided with an engagement means gripping the abutment face of a clamp and the second lever is provided with an extending cam fitting into a recess of an actuating lever opening and closing jaws of a respective clamp, and wherein further the second lever is arranged to turn with respect to the first lever against the force of a spring or the like, the piston-cylinder means first turning both levers together and, when the first lever stops against the abutment, the piston-cylinder means turns the second lever with respect to the first lever.

7. Apparatus according to claim 6 wherein further the first lever is fitted with a sensing hair to be moved therewith.

8. In a hide stretching apparatus, in particular for the tentering of wet hides for drying, of the type comprising in combination:

a stretching frame having peripherally attached thereto and radially extending inwardly therefrom a plurality of guides, each of said guides having a first end affixed to said frame and a second end affixed to a center piece located centrally in said frame;

a like plurality of clamps, individual ones of said clamps being slidably attached to corresponding ones of said guides so as to be movable in an inward direction and an outward direction, respectively toward said second end and said first end of a corresponding one of said guides, each of said clamps being provided with a pair of jaws operable between an open position and a closed position, said jaws being so disposed and dimensioned as to be capable of grasping an edge of a hide when in said closed position and releasing said edge when in said open position; and a hide changing table provided with a clamp displacement member for each of said clamps, said clamp displacement member being dimensioned and disposed so as to be capable of translating an individual one of said clamps along said corresponding one of said guides;

the improvement comprising a plurality of support strips affixed to said hide changing table, said support strips being dimensioned and disposed to fit adjacent said guides when said stretching frame is aligned on said hide changing table; and a vertically movable press means provided with press members disposed in confronting relationship to said support strips, said press members being secured to a centre plate of the press means by means of flexible arms, said press members being so dimensioned and disposed as to grasp a hide when said press means is in its lowermost position and release said hide when said press means is in its upermost position, said flexible arms being disposed to make a small angle with said support strips when said press means is in its upermost position whereby when said press means is brought toward its lowermost position said press members move radially outward from said centre plate.

9. Apparatus according to claim 8 wherein further said support strips have a smooth sliding upper face and said press members have a nonslipping gripping lower face of rubber.

10. Apparatus according to claim 1, 4, 5, 8, 2, 3, or 9, characterized in that said press means includes a centre plate and a plurality of arms connecting said centre plate with said press members, said arms being pivotably fitted and locable to the centre plate and to ones of said press members.

* * * * *

UNITED STATES PATENT AND TRADEMARK OFFICE

CERTIFICATE OF CORRECTION

PATENT NO. : 4,335,594

DATED : June 22, 1982

INVENTOR(S) : Antti K. Viljanmaa

It is certified that error appears in the above-identified patent and that said Letters Patent are hereby corrected as shown below:

Claim 1, Column 4, line 15, delete "upermost" and substitute therefor -- uppermost --;
Claim 2, Column 4, line 19, delete "upermost" and substitute therefor -- uppermost --;
Claim 4, Column 5, line 3, delete "upermost" and substitute therefor -- uppermost --;
Claim 5, Column 5, line 5, delete "paralles" and substitute therefor -- parallel --;
Claim 5, Column 5, line 9, delete "upermost" and substitute therefor -- uppermost--;
Claim 6, Column 5, line 24, delete "between" (second occurrence);
Claim 8, Column 6, line 33, delete "upermost" and substitute therefor -- uppermost --;
Claim 8, Column 6, line 35, delete "upermost" and substitute therefor -- uppermost --;
Claim 10, Column 6, line 47, delete "locable" and substitute therefor -- lockable --.

Signed and Sealed this

*Twenty-first* Day of *September 1982*

[SEAL]

*Attest:*

GERALD J. MOSSINGHOFF

*Attesting Officer*

*Commissioner of Patents and Trademarks*